US006877502B2

(12) United States Patent
Register

(10) Patent No.: US 6,877,502 B2
(45) Date of Patent: Apr. 12, 2005

(54) MULTI-BLADE CONCRETE CUTTING SAW

(76) Inventor: Sean Register, P.O. Box 1807, Richmond Hill, GA (US) 31324

( * ) Notice: Subject to any disclaimer, the term of this patent is extended or adjusted under 35 U.S.C. 154(b) by 0 days.

(21) Appl. No.: 10/455,396

(22) Filed: Jun. 6, 2003

(65) Prior Publication Data

US 2004/0244788 A1 Dec. 9, 2004

(51) Int. Cl.[7] ..... B28D 1/04

(52) U.S. Cl. ..... 125/13.01; 425/12; 425/35; 451/336; 198/577

(58) Field of Search ..... 125/13.01, 12, 125/35; 451/336, 337, 339, 457; 198/577; 83/522.11, 425.2, 56, 425.3, 425.1, 429, 110

(56) References Cited

U.S. PATENT DOCUMENTS 3,168,835 A * 2/1965 Nuss, Jr. ..... 474/114
3,608,969 A 9/1971 Fowkes
3,998,115 A 12/1976 Cornell
4,043,231 A 8/1977 Friedberg
4,141,193 A * 2/1979 Joa ..... 53/529
4,458,403 A * 7/1984 Foster ..... 29/434
4,676,361 A * 6/1987 Heisler ..... 198/394
4,678,073 A * 7/1987 Anderson et al. ..... 198/396
4,909,139 A 3/1990 Montano et al.
5,056,272 A * 10/1991 Battaglia ..... 451/41
5,085,008 A * 2/1992 Jennings et al. ..... 451/184
5,167,215 A 12/1992 Harding, Jr.
5,333,526 A 8/1994 Suzuki
6,073,621 A 6/2000 Cetrangolo
6,393,956 B1 5/2002 Blum et al.

* cited by examiner

*Primary Examiner*—George Nguyen
(74) *Attorney, Agent, or Firm*—Richard C. Litman

(57) ABSTRACT

The multi-blade concrete cutting saw cuts blocks of concrete or aerated concrete into equal sized slates with one pass through the saw. The cutting saw is supported by a frame having a base, an upper support structure and a pair of guide rails. A conveyor track transports the concrete blocks through the cutting saw. A concrete block is forced along the conveyor track and passes through six equally spaced, diamond tipped cutting blades. Each of the resultant slates have equal dimensions and weight. The cutting blades are disposed along a drive shaft and are arranged across the width of the conveyor track. The cutting blades are driven in a counterclockwise direction by a drive belt that connects the drive shaft to a motor. The conveyor track may be automatically driven by a pair of belt drives.

17 Claims, 5 Drawing Sheets

MULTI-BLADE CONCRETE CUTTING SAW

BACKGROUND OF THE INVENTION

1. Field of the Invention

The present invention relates to cutting tools and more particularly to a multi-blade cutting saw for cutting a block of concrete or aerated concrete into a plurality of equally sized slates with one pass through the cutting saw.

2. Description of the Related Art

Roofing tiles are commonly being made from concrete and particularly aerated concrete. Concrete and aerated concrete are usually produced in large blocks that need to be cut into slates or tiles. It is important to accurately cut the concrete so that each slate has equal dimensions. It is also important to be able to cut the concrete blocks without damaging the integrity of the concrete. Most concrete cutting saws provide a single blade. The single blade must make several passes over each concrete block to cut it into several slates. It is often difficult to cut slates with equal dimensions using a single blade cutting saw. The following patent documents disclose concrete cutting saws and cutting saw apparatus.

U.S. Pat. No. 3,608,969 discloses a tractor with a grooving unit for cutting parallel grooves into concrete pavement. The grooving unit contains a number of rotating saw blades. The tractor includes a shock absorber that prevents the saw blades from being damaged when contacting the pavement.

U.S. Pat. No. 3,998,115 discloses a multiple rip saw for cutting wood. The rip saw apparatus includes a single arbor gang blade ripping saw, a top arbor and a means for controlling the disposition of the feed drive. The wood is fed through the rip saw on a conveyor that is driven by a motor.

U.S. Pat. No. 4,043,231 discloses an apparatus for trimming and scoring sod to produce separable plugs. The scoring apparatus produces a plurality of parallel cuts through the sod in one direction while trimming the ends of each section to a uniform length. The sod sections are turned ninety degrees and are conveyed through a second scoring apparatus that produces a plurality of parallel cuts in a second, perpendicular direction.

U.S. Pat. No. 4,909,139 discloses an apparatus for sub dividing hay bales. The machine cuts a block of hay into a plurality of smaller sections of hay. The machine has a conveyor that transports hay into a sawing section. The sawing section contains two sets of saw blades that are arranged transversely for making horizontal and vertical cuts through the hay bale. A second conveyor belt transports the cut pieces-into an outlet shoot.

U.S. Pat. No. 5,167,215 discloses a dust removal apparatus for a concrete cutting saw. The dust removal apparatus contains a blade guard that partially covers the cutting blade and a pivotally mounted funnel on the blade guard. A vacuum machine is connected to an exhaust duct of the funnel so that concrete dust generated during cutting is exhausted away from the blades as the cuts are being made.

U.S. Pat. No. 5,333,526 discloses a running saw system. The system includes a carry conveyor with a plurality of rollers for transporting a slab of material to a cutting area. A cut saw then transversely cuts the front end of the slab a predetermined distance. The cut pieces of the slab are then carried away from the cutting area on a discharge conveyor.

U.S. Pat. No. 6,073,621 discloses a machine for cutting corner lines in stones. The machine includes two pair of saw blades, which are disposed in opposite directions to one another. The saw blades are adjustable with respect to each other to accurately locate the-corners of the stone. Laser light sources are positioned to provide light beams on the stone at the precise location where the cuts are to be made.

U.S. Pat. No. 6,393,956 discloses a device for cutting any width of wood or other material. The machine includes a plurality of saw blades disposed on a drive shaft. Support bodies are provided on the drive shaft for each saw blade. The cutting blades may be displaced along the drive shaft so that displacement of the cutting width is possible without having to dismantle the saw blades.

None of the above inventions and patents, taken either singly or in combination, is seen to describe the instant invention as claimed. Thus a multi-blade concrete cutting saw solving the aforementioned problems is desired.

SUMMARY OF THE INVENTION

The multi-blade concrete cutting saw cuts blocks of concrete or aerated concrete into a number of equal sized slates or tiles with one pass through the saw. The cutting saw is supported by a frame having a base, an upper support structure and a pair of guide rails. A PVC roller conveyor track is positioned on top of the base of the frame. The conveyor track transports the concrete blocks through the cutting saw. A concrete block is forced along the conveyor track and passes through six equally spaced, diamond tipped cutting blades that cut the block into six slates or tiles. Each of the resultant slates have equal dimensions and weight. The slates are then transported to the end of the conveyor track where they are stopped by a foam pad.

The cutting blades are disposed along a drive shaft and are arranged across the width of the conveyor track. The cutting blades are driven in a counterclockwise direction by a drive belt that connects the drive shaft to a motor. The cutting blades are spaced apart by a plurality of adjustable locking spacers. The locking spacers also serve to secure the cutting blades to the drive shaft. The dimensions of the resultant slates can be changed by changing the size and number of the cutting blades or the size of the spacers between the cutting blades.

The motor is positioned on a jack plate that is adjustably mounted to the top of the upper support structure. The jack plate is secured to the upper support structure by a plurality of threaded fasteners. The jack plate may be adjusted vertically along the threaded fasters. The jack plate is adjusted to compensate for the wear and tear of the drive belt. As the drive belt is used and is worn it stretches. In order to keep the belt tight the jack plate raises the motor to compensate for the increased length of the drive belt.

The multi-blade cutting saw also has a housing that is attached to the upper support structure of the frame. The housing covers the cutting blades. A dust collecting pipe is attached to the housing to remove debris from the area of the cutting blades.

The conveyor is declined from its input end to its output end to aid in transporting the concrete through the cutting saw. A base board is slidably disposed on the conveyor track to further aid in transporting the concrete through the cutting saw. The block of material may be forced along the conveyor track by a movement actuator. The block of material may be manually forced by using a 2×4 to push the concrete. Also, the actuator may be a hydraulic ram that pushes the concrete along the conveyor. Finally, the conveyor track may be automatically driven by a pair of belt drives.

Accordingly, it is a principal object of the invention to provide a multi-blade cutting saw for cutting concrete and aerated concrete blocks.

It is another object of the invention to provide a multi-blade cutting saw that can cut a block of aerated concrete into six slates with one pass through the saw.

It is a further object of the invention to provide a multi-blade cutting saw that can consistently produce slates that are equal in size and weight.

Still another object of the invention is to provide a multi-blade cutting saw that may be fully automatic.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a multi-blade cutting saw for making a number of cuts in a block of material in a single pass through the cutting saw. The multi-blade cutting saw is preferably used for cutting blocks of concrete, especially aerated concrete, into roof slates or tiles. Each of the roof slates produced by cutting the concrete block are the same size and weight.

Figure 1:
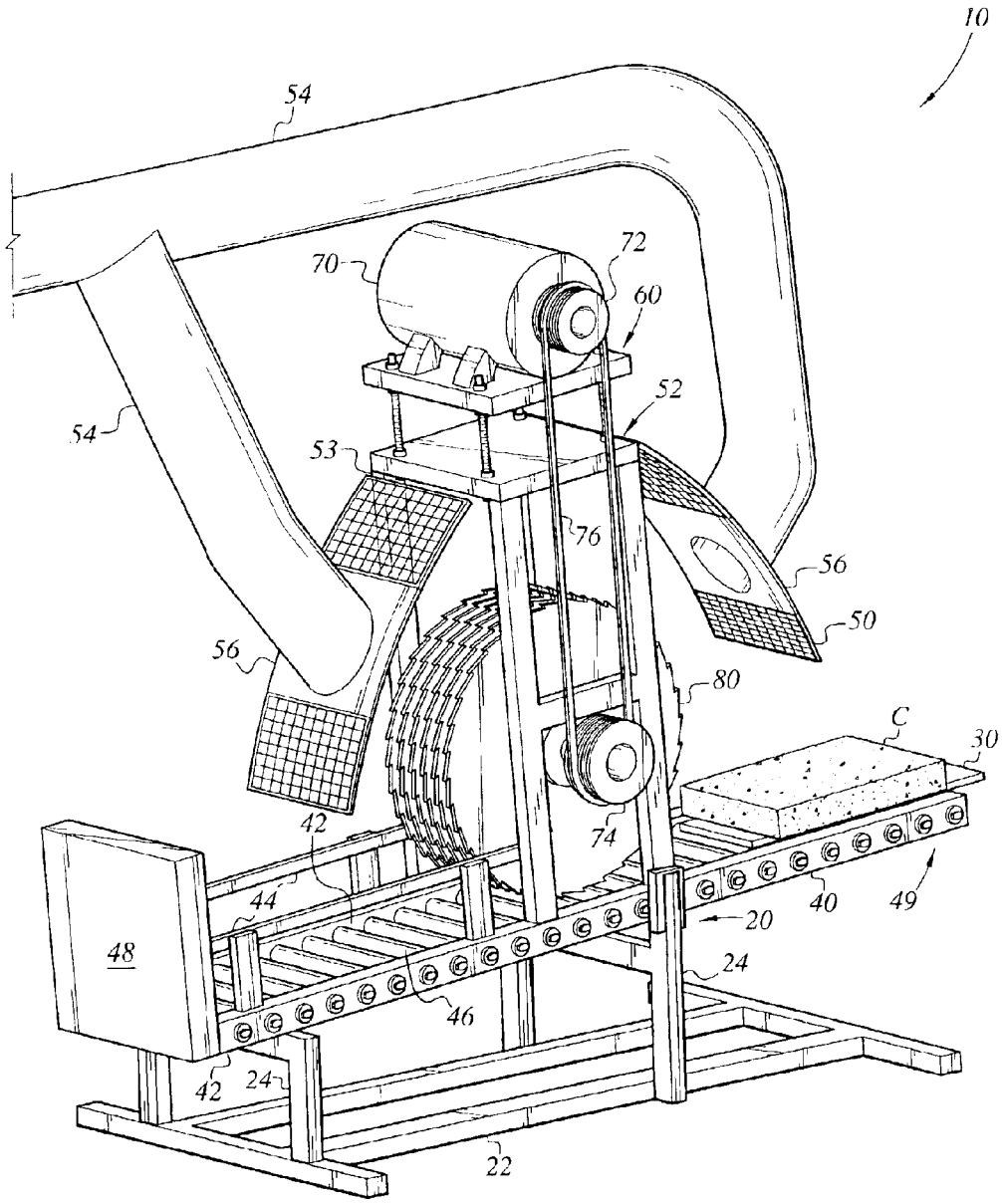
FIG. 1 is an environmental, perspective view of a multi-blade concrete cutting saw according to the present invention.

FIG. 1 depicts an environmental, perspective view of a multi-blade cutting saw 10. The cutting saw 10 is supported by a frame 20. The frame 20 comprises a base portion 22 having a plurality of support legs 24, an upper support structure 52 having a plurality of support posts 53 and a cover 62, and a pair of guide rails 44. The frame 20 is erected with the base portion 22 securely planted on the floor to provide a sturdy support for the cutting saw 10.

A conveyor track 40 is disposed on top of the support legs 24 and is supported by the frame 20. The conveyor track 40 comprises two side rails 42 and a plurality of PVC rollers 46 horizontally disposed between the two side rails 42. Each of the guide rails 44 of the frame 20 are positioned along one of the side rails 42. A stopping pad 48 is positioned at the output end of the conveyor track 40. The stopping pad 48 is preferably made of foam and acts to prevent the concrete slates from falling off of the conveyor track 40 once they have been cut. The conveyor track 40 is oriented in a declined position from the input end 49 to the output end. The declining slope of the conveyor track 40 aids in transporting the block of concrete C through the cutting saw 10. A transporting board 30 is slidably disposed on the conveyor track 40. The concrete block C is placed on the transporting board 30, which carries the concrete block C along the conveyor track 40.

The multi-blade cutting saw 10 further includes a housing 50 that covers the cutting blades 80. The housing 50 is attached to the cover 62 of the upper support structure 52. The housing 50 is a mesh cage made from sheet metal. A pair of dust collector tubes 54 are secured to the housing 50 on either side of the upper support structure 52. The dust collector tubes 54 are secured to the housing 50 by tube mounting plates 56. The dust collector tubes 54 collect the dust from the cutting block C and transport it away from the cutting saw 10. Arrows 100 (shown in FIG. 3) depict the direction that the dust is transported through the dust collector tubes 54.

The cutting blades 80 are driven by a motor 70, which is positioned on a jack plate 60. The jack plate 60 is disposed on top of the upper support structure 52. The motor 70 is either a gas or electric motor and it powers a driving belt 76. The driving belt 76 connects the motor 70 to the cutting blades 80 by passing over an upper belt drive 72 and a lower belt drive 74. The motor 70 and driving belt 76 cause the cutting blades 80 to rotate counterclockwise.

Figure 2:
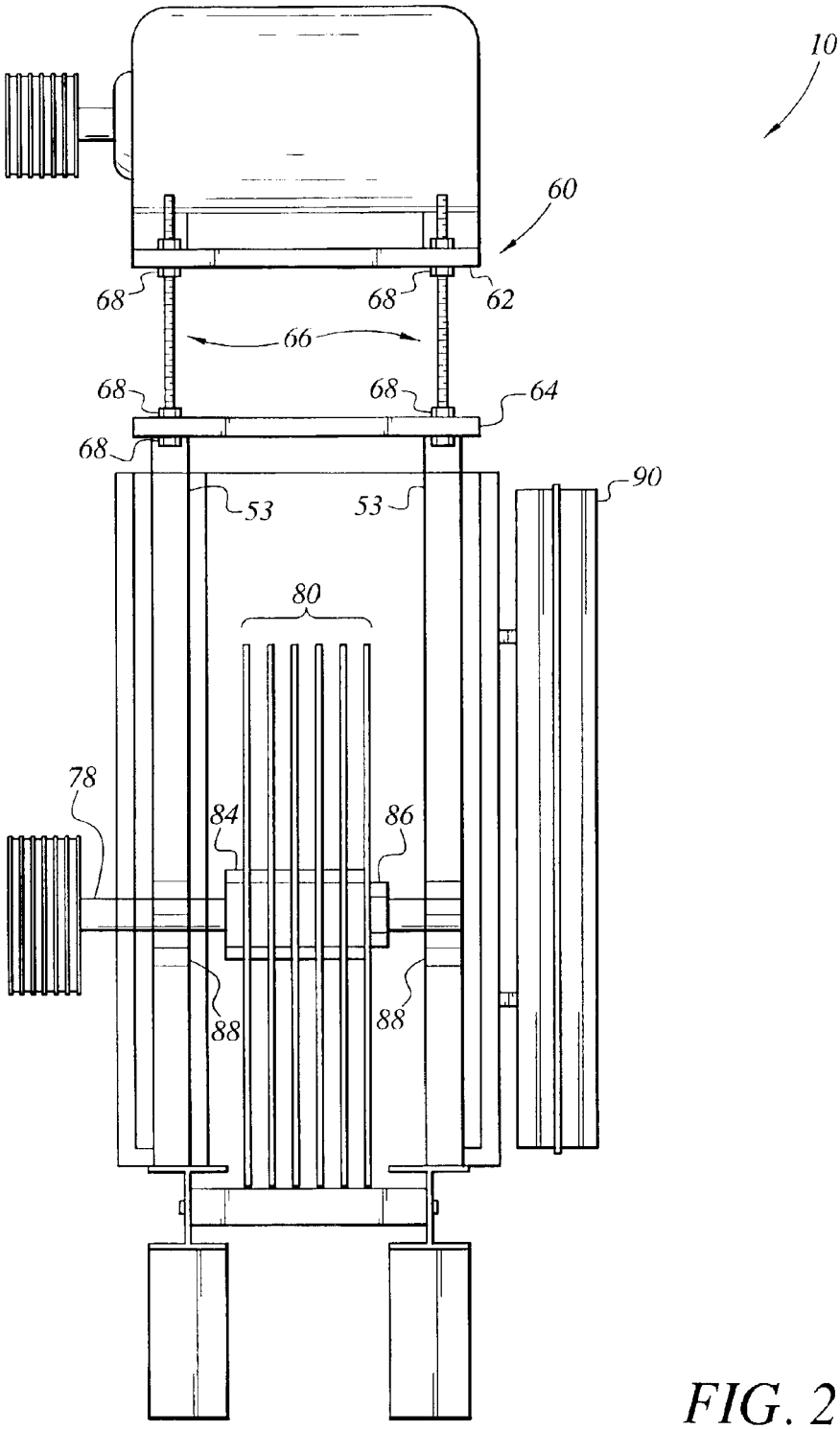
FIG. 2 is a side view of the multi-blade concrete cutting saw.

The jack plate 60 is adjustably secured to the cover 64 by a plurality of threaded fasteners 66 and locking nuts 68 (shown in FIG. 2). The threaded fasteners 66 allow the top plate 62 of the jack plate 60 assembly to move up and down in relation to the upper support structure 52. The top plate 62 is adjusted to increase or decrease tension in the driving belt 76. Over time the driving belt 76 will stretch as it is worn. When the belt 76 stretches it will become loose. Instead of replacing the driving belt 76, the jack plate 60 assembly raises the top plate 62 and increases the distance between the motor 70 and the lower belt drive 74. When the jack plate 60 raises the motor 70 the tension in the drive belt 76 is restored.

FIG. 2 is a side view of the multi-blade cutting saw 10 with the housing 50 removed to reveal the plurality of cutting blades 80. The cutting saw 10 preferably comprises six equally spaced cutting blades 80. Any number of cutting blades 80, however, may be used and the cutting saw is not limited to using only six blades. The cutting blades 80 are disposed along a drive shaft 78 and are arranged across the conveyor track 40. The cutting blades 80 further comprise a plurality of saw teeth 82 (shown in FIG. 3) disposed around the periphery of the cutting blades 80. The drive shaft 78 is secured to the support posts 53 of the upper support structure 52 by a plurality of bearings 88. The cutting blades 80 are adjustably secured to the drive shaft 78 by a plurality of locking spacers 84. The locking spacers 84 further act to maintain an equal amount of separation between each of the cutting blades 80. A threaded lock nut 86 is positioned against the cutting blade furthest from the driving belt 76 to further secure the cutting blades 80 in place.

Figure 3:
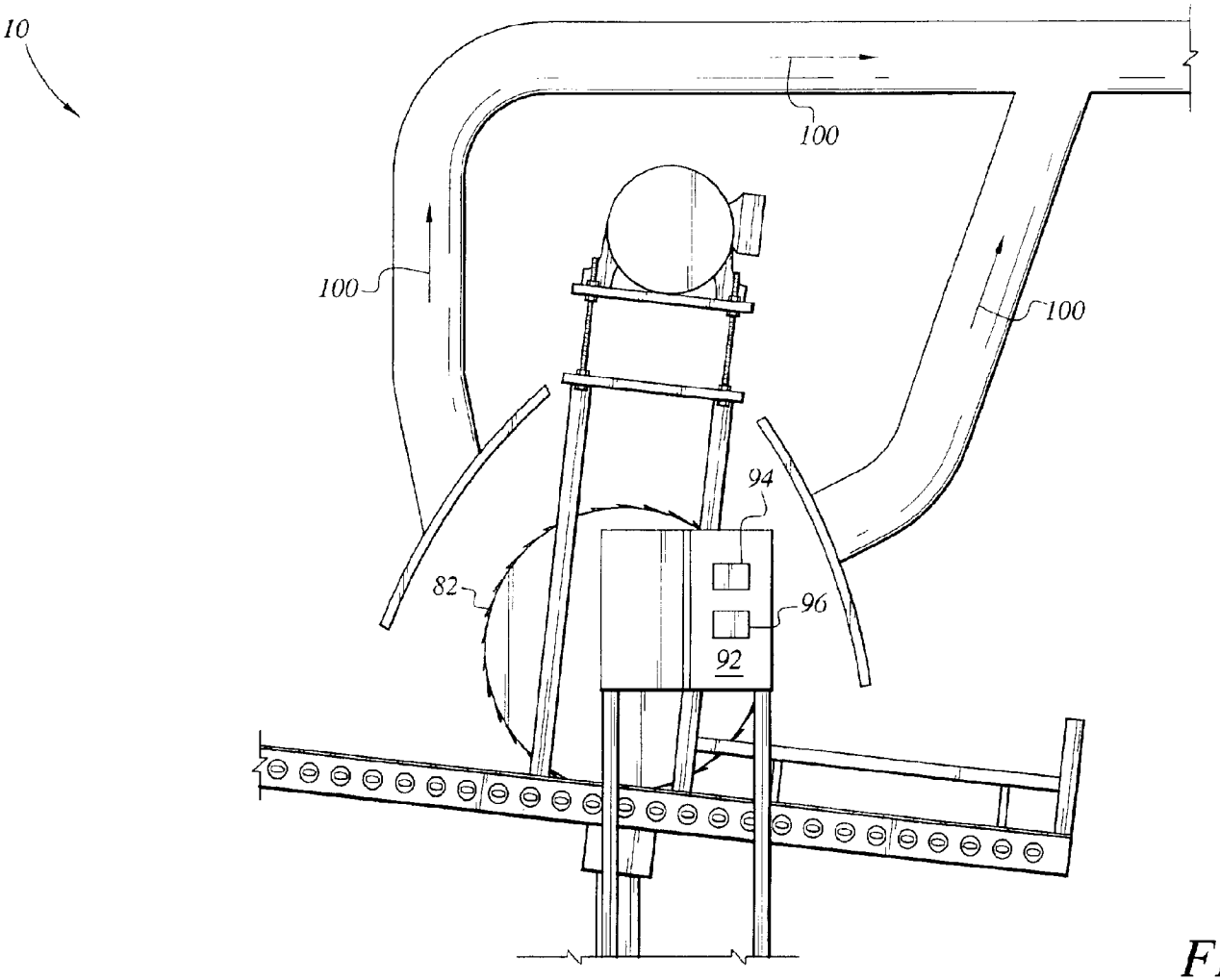
FIG. 3 is a rear view of the multi-blade concrete cutting saw.

FIG. 3 is a rear view of the multi-blade cutting saw 10. The multi-blade cutting saw 10 further comprises a control panel. 90 for controlling the operations of the cutting saw 10. A plurality of control switches are disposed on the front surface 92 of the control panel 90. The plurality of control switches include a power on/off lever 94 and a start/stop switch 96.

Referring to FIG. 1, the block of concrete C is cut into six slates or tiles of equal size and weight. The concrete C is fed into the saw 10 on the declined conveyor track 40. A force must be applied to the block of concrete C to move it along the conveyor track 40. The block of concrete C may be manually urged along the conveyor track 40 by pushing the transporting board 30 with a 2×4. The cutting blades 80, which are powered by the motor 70 and drive belt 76, rotate counterclockwise into the block of concrete C. After the block of concrete C is cut into the equally sized slates it exits the saw on the conveyor track 40.

Figure 4:
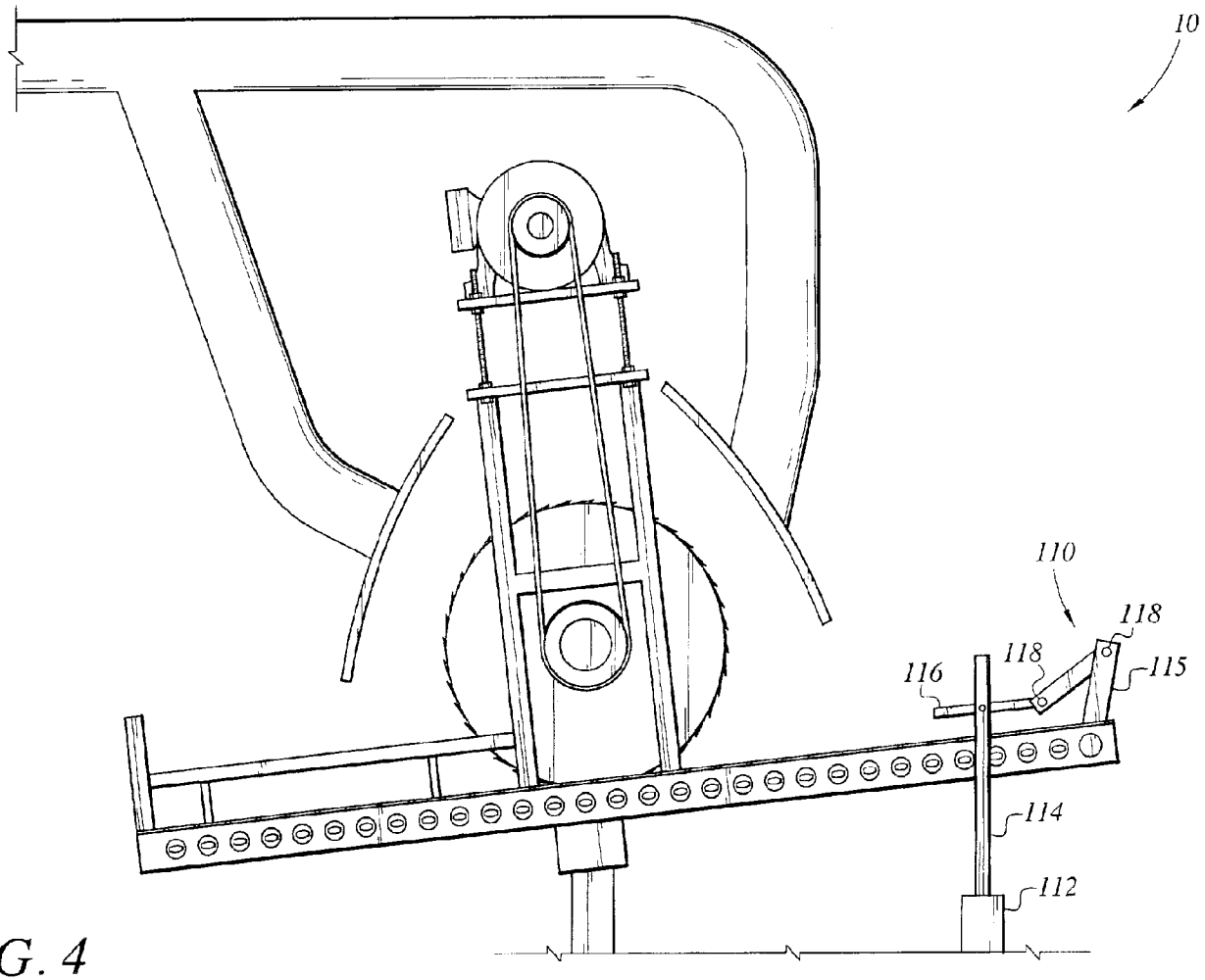
FIG. 4 is a front view of a second embodiment of the concrete cutting saw.

FIG. 4 depicts an alternate embodiment of the present invention. Instead of forcing the block of concrete C along the conveyor track 40 manually with a 2×4, the block of concrete C may be urged by a hydraulic ram 110. The hydraulic ram 110 includes a hydraulic cylinder 116, which moves forward and backward to apply a force onto the block of concrete C. The hydraulic cylinder 116 is secured to a pivoting arm 115 that is secured to the input end 49 of the conveyor track 40. The hydraulic ram 110 is powered by a hydraulic pump 112. The hydraulic pump 112 has an actuator arm 114 that is attached to the hydraulic cylinder 116 and causes the hydraulic cylinder 116 to move forward and backward to apply force on the block of concrete C. The pivoting arm 115 pivots about pivot points 118 to allow the hydraulic ram 110 to extend along the conveyor track 40 to urge the block of concrete C completely through the multi-blade cutting saw 10.

Figure 5:
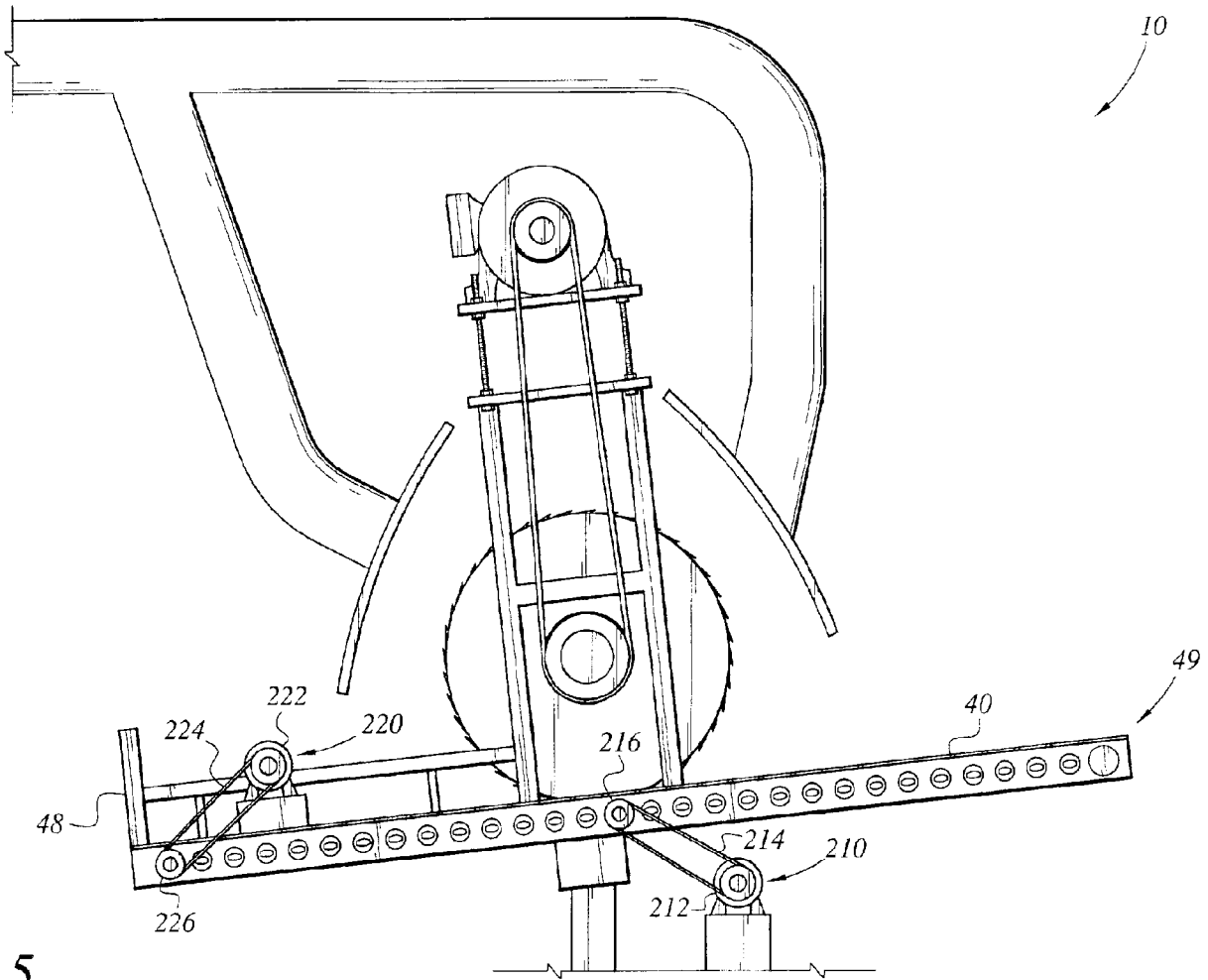
FIG. 5 is a front view of an additional, automated embodiment of the present invention.

FIG. 5 depicts an additional embodiment of the present invention where no actuator is needed to force the block of concrete C along the track. The multi-blade cutting saw 10 in FIG. 5 further comprises a completely automated conveyor track 40. The conveyor track 40 in the present embodiment is powered by an input conveyor drive 210 and an output conveyor drive 220. The input conveyor drive 210 comprises a motor 212, a drive belt 214 and drive shaft 216. The output conveyor drive 220 is disposed at the output end 48 of the conveyor track 40. The output drive 220 comprises a motor 222, a drive belt 224 and a drive shaft 226. The input drive 210 powers the conveyor track 40 and transports the block of concrete C along the conveyor track 40 from the input end 49 to the cutting blades 80 at a first speed. Once the block of concrete C has been cut, the input drive is turned off and the output drive 220 powers the conveyor track 40 and transports the block of concrete C from the cutting blades 80 to the output end 48 of the conveyor track 40 at a faster second speed.

It is to be understood that the present invention is not limited to the embodiments described above, but encompasses any and all embodiments within the scope of the following claims.

I claim:

1. A multi-blade cutting saw system, comprising:

a frame having a base portion, an upper support structure and a pair of guide rails;

a conveyor track having an input end and an output end, the conveyor track being supported on the base portion of said frame;

a stopping pad disposed at the output end of said conveyor track;

a jack plate coupled to said upper support structure;

a plurality of threaded fasteners coupling said jack plate to said upper support structure;

said jack plate being adjustably secured to said upper support structure by said plurality of threaded fasteners;

a motor disposed on said jack plate;

a drive shaft supported on said frame, between said upper support structure and said conveyor track;

a plurality of cutting blades disposed on said drive shaft, said plurality of cutting blades being equidistantly spaced apart along said drive shaft;

a plurality of adjustable locking spacers that separate said cutting blades and secure said cutting blades along said drive shaft;

a drive belt connected between said drive shaft and said motor, said drive belt responsive to said motor for causing said plurality of cutting blades to rotate about said drive shaft;

wherein said drive belt mechanically translates rotation from said motor to said drive shaft, the coupling of said drive belt between said motor and said drive shaft is maintained by the adjustment of said jack plate by said threaded fasteners;

a housing attached to said upper support structure for covering said plurality of cutting blades;

a dust collecting pipe secured to said housing for transporting debris away from the multi-blade cutting saw; and a base board slidably disposed on said conveyor track for carrying said block of material along said conveyor track;

wherein a block of material is moved along said conveyor track for engaging said plurality of cutting blades, so that the block of material is cut into a plurality of equal sized pieces in a single pass.

2. The multi-blade cutting saw system according to claim 1, further comprising a control panel for providing operational control functions.

3. The multi-blade cutting saw system according to claim 1, wherein said plurality of cutting blades comprises about six equally spaced cutting blades.

4. The multi-blade cutting saw system according to claim 3, wherein each blade has a plurality of saw teeth disposed along the outer periphery thereof.

5. The multi-blade cutting saw system according to claim 3, wherein said cutting blades are diamond tip cutting blades.

6. The multi-blade cutting saw system according to claim 1, wherein said conveyor track is a roller conveyor.

7. The multi-blade cutting saw system according to claim 1, wherein said motor is selected from the group consisting essentially of electric motors and gas motors.

8. The multi-blade cutting saw system according to claim 1, wherein said adjustable locking spacers are variably sized so as to change the distance between said cutting blades.

9. The multi-blade cutting saw system according to claim 1, further comprising an actuator for moving the block of material along said conveyor track.

10. The multi-blade cutting saw system according to claim 9, wherein said actuator is selected from the group consisting of manual actuators, and hydraulic actuators, and automatic actuators.

11. The multi-blade cutting saw system according to claim 9, wherein said actuator for moving further includes an input belt drive and an output belt drive, said input belt drive and said output belt drive operatively cooperating for automatically driving the block of material along said conveyor track;

wherein said input belt drive operates at a first speed, and said output belt drive operates at a second speed.

12. The multi-blade cutting saw according to claim 11, wherein said first speed and said second speed are not equal.

13. The multi-blade cutting saw according to claim 11, wherein said second speed is greater than said first speed.

14. The multi-blade cutting saw system according to claim 1, wherein said stopping pad includes a foam pad.

15. The multi-blade cutting saw system according to claim 14, wherein said conveyor track slopes downwardly from said input end to said output end.

16. The multi-blade cutting saw system according to claim 1, wherein said housing is a mesh cage made from sheet metal.

17. A multi-blade cutting saw system, comprising:

a frame having a base portion, an upper support structure and a pair of guide rails;

a conveyor having an input end, including at least one supporting base board, and an output end including an end stop;

said input end of said conveyor has an input belt drive and said output end of said conveyor has an output belt drive;

wherein the conveyor is supported above said base portion of said frame;

said upper support structure disposed above said conveyor, said upper support structure including a jack plate, and a plurality of adjustable threaded fasteners;

said jack plate being adjustably secured to said upper support structure by said plurality of threaded fasteners;

a motor disposed on said jack plate;

a drive shaft supported on said frame, between said upper support structure and said conveyor track;

a plurality of cutting blades and a plurality of lockable spacers disposed on said drive shaft;

wherein said plurality of locking spacers equidistantly spacing apart said plurality of cutting blades along said drive shaft;

a drive belt connected between said drive shaft and said motor, said drive belt responsive to said motor for causing said plurality of cutting blades to rotate about said drive shaft;

a housing having at least one dust collecting pipe, said housing being attached to said upper support structure for covering said plurality of cutting blades;

wherein said dust collecting pipe transports debris away from said plurality of cutting blades; and a base board slidably disposed on said conveyor track for carrying said block of material along said conveyor track;

wherein during operation a block of material placed on a base board, said input drive belt automatically moving the block of material on said base board along said conveyor track at a first speed, said plurality of cutting blades engaging the block of material so as to cut the block of material into a plurality of equal sized pieces in a single pass, and said output belt drive moving the cut pieces of material from said plurality of cutting blades to the output end of said conveyor track at a higher speed than said first speed.

* * * * *